United States Patent [19]

Sodec et al.

[11] Patent Number: 5,001,968

[45] Date of Patent: Mar. 26, 1991

[54] GROCERY STORE AIR CONDITIONING SYSTEM HAVING DROP-DOWN DIFFUSER UNITS THEREFOR

[75] Inventors: Franc Sodec, Anselm Feuerbachstr, Fed. Rep. of Germany; Donald L. Hudson, Matthews; David T. Bolen, Charlotte, both of N.C.

[73] Assignee: Hudson Associates, Inc., Charlotte, N.C.

[21] Appl. No.: 446,927

[22] Filed: Dec. 6, 1989

Related U.S. Application Data

[63] Continuation-in-part of Ser. No. 360,406, Jun. 2, 1989.

[51] Int. Cl.[5] ..... F24F 13/062

[52] U.S. Cl. ..... 98/40.05; 62/255; 98/40.15

[58] Field of Search ..... 98/31.5, 31.6, 33.1, 98/34.5, 34.6, 40.05, 40.13, 40.15, 40.16; 62/247, 255, 249, 404, 407, 410, 411, 412

[56] References Cited

U.S. PATENT DOCUMENTS

| | | | |
|---|---|---|---|
| 2,207,201 | 7/1940 | Kurth . | |
| 2,848,934 | 8/1958 | Allander . | |
| 3,240,145 | 3/1966 | Lambert . | |
| 3,503,320 | 3/1970 | Geromet . | |
| 3,824,909 | 7/1974 | Horneff et al. . | |
| 3,854,386 | 12/1974 | Hedrick . | |
| 3,906,846 | 9/1975 | Day . | |
| 4,078,476 | 3/1978 | Widerby . | |
| 4,109,564 | 8/1978 | Widerby . | |
| 4,191,543 | 3/1980 | Peters | 55/279 |
| 4,259,898 | 4/1981 | Finkelstein et al. . | |
| 4,655,806 | 5/1987 | Martin, Sr. | 98/40.12 |
| 4,693,176 | 9/1987 | Deeg et al. | 98/40.12 |

FOREIGN PATENT DOCUMENTS

| | | | |
|---|---|---|---|
| 886544 | 4/1981 | Belgium . | |
| 2908681 | 9/1979 | Fed. Rep. of Germany | 98/40.12 |
| 8003910 | 2/1980 | Fed. Rep. of Germany . | |
| 3600821 | 7/1986 | Fed. Rep. of Germany . | |
| 3631967 | 3/1987 | Fed. Rep. of Germany . | |
| 547539 | 12/1922 | France . | |
| 648923 | 4/1985 | Switzerland . | |

*Primary Examiner*—Harold Joyce

*Attorney, Agent, or Firm*—Bell, Seltzer, Park & Gibson

[57] ABSTRACT

An air conditioning system for a grocery store having refrigerated food displays along certain aisles of the store includes a plurality of ceiling mounted air outlet diffuser units. A plurality of the units are positioned substantially above the aisles adjacent the refrigerated food displays. Each diffuser unit is positioned above the aisle adjacent the refrigerated food displays and is constructed so as to provide a downward flow of conditioned air into the store and over an extended area of the aisle in a manner so that shoppers receive conditioned air free of drafts while heavy, cool, stagnant air lying adjacent the refrigerated food displays is induced upwardly into upper regions of the store. Each diffuser unit has a housing with a flared air exit mouth which includes an outwardly extending arcuate surface to define a rounded outlet mouth thereat so that some horizontal discharge of air always is provided. A tubular air passageway within the housing includes an annular air passageway therebetween. A plurality of vanes are positioned in the annular passageway for producing rotational, highly turbulent currents of air flowing from the passageway. A plug-like valve controls the volume of air passing through the tubular air passageway and controls the flow pattern of the vertically directed currents of air. Both the rounded air exit mouth and the lower end of the annular air passageway extend below the store ceiling a predetermined distance so as to avoid air flowing from the annular passageway outwardly along the face of the ceiling and creating an undesirable coanda effect.

24 Claims, 3 Drawing Sheets

GROCERY STORE AIR CONDITIONING SYSTEM HAVING DROP-DOWN DIFFUSER UNITS THEREFOR

This application is a continuation-in-part of patent application Ser. No. 07/360,406, filed June 2, 1989.

BACKGROUND OF THE INVENTION

In the parent case, an air conditioning system for a grocery store having refrigerated food displays along certain aisles of the store is disclosed. Air outlet diffuser units are mounted in the ceiling of the store and positioned substantially above the aisles adjacent the refrigerated food displays. These diffuser units are constructed to provide a downward flow of conditioned air into the store in such a manner that the shoppers moving about the aisles therebelow receive conditioned air substantially free of drafts for aiding in shopper comfort. The diffuser units are disclosed as including a housing with an outwardly stepped lip configuration defining the air exit mouth. Means defining a tubular air passageway is positioned coaxially of the housing and also defines an annular air passageway therebetween. A plurality of vanes are mounted in the annular passageway for producing rotational, highly turbulent currents of air. Means associated with the tubular air passageway controls the volume of air passing therethrough and also controls the flow pattern of air flowing from the annular air passageway so that as the volume of air passing through the tubular air passageway is increased, the current of air discharged from the annular air passageway is directed downwardly in a more vertical direction.

The stepped exit mouth and lower end of the annular air passageway of each diffuser unit extend below the ceiling surface approximately three inches to minimize the development of a partial vacuum between the jet of discharged air and the ceiling surface which would cause the jet of discharged air to flow along the ceiling surface in an undesirable coanda effect. Additionally, the stepped configuration at the outlet provides a disrupted surface for effecting a more downwardly directed flow of conditioned air exiting from the annular passageway into the grocery store. Air exiting the annular passageway tends to follow the initial, outwardly curved, inside surface of the housing. When the exiting air contacts the disrupted, stepped surface, this gentle flow is disrupted, and as a result, the air flow is directed downwardly instead of horizontally. An annular air control flange is movable relative to the annular passageway to maintain a desired velocity of air along the stepped surface so that when the amount of air flowing through the annular passageway is decreased, the velocity of air engaging the stepped surface is maintained to effect the desired disruption and provide a more downwardly flow of air thereat.

The foregoing air diffuser unit is well suited for use in grocery stores where the ceiling height can extend to heights of twelve to fifteen feet and more. Fifteen foot grocery store ceilings are not uncommon. The stepped configuration at the housing outlet provides the necessary disruption to the air flow for effecting a more downward flow of air. However, one drawback of the aforementioned diffuser design is that the stepped outlet does not provide for much horizontal air flow except when air flow through the tubular air passageway is minimized. At times, it may be more desirable to have some horizontal discharge of air exiting the annular air passageway when the air flow through the tubular air passageway is at a maximum. A horizontal discharge of air would effect a more bell-shaped air flow distribution and effect mixing over an extended aisle surface area. As a result, the total number of air diffusers positioned above the aisles can be reduced because the diffusers can be more spaced-apart. One possible drawback of increasing the horizontal discharge from the diffuser is that the effective vertical throw of air discharged from the diffuser will be reduced. However, where the grocery store ceiling height is about 12 feet or less, it is believed that the reduction in vertical discharge will not adversely affect the successful operation of the air conditioning system. A more bell-shaped air flow distribution having a reduced vertical throw of air therefrom will still provide a downward flow of air into an aisle to induce upwardly the heavy, cool, stagnant air lying adjacent the refrigerated food displays when the grocery store ceiling heights are limited, i.e. about 12 feet or less.

One similar air diffuser design disclosed in German Gebrauchmuster 8,003,910, Feb. 14, 1980, Belgium Patent No. 886,544, Apr. 1, 1981, and Swiss patent No. 648,923, Apr. 15, 1985, includes a rounded instead of a stepped outlet. The rounded outlet always provides some horizontal discharge of air outwardly from the annular air passageway. The rounded outlet provides a smooth, uninterrupted surface on which a small vacuum can be created between the surface and the exiting air so that some air will flow along the rounded surface and then outwardly in a horizontal direction therefrom.

It has heretofore been considered impracticable to use the rounded outlet diffuser units with grocery store ceilings which typically are high ceilings because the rounded outlet always provides for some horizontal discharge of air, thus diminishing the extent of the vertical throw necessary with high ceilings. The disclosed diffuser is also expensive because it uses a servo motor to control the plug-like valve of the opening in the axial passageway and incorporates a movable, annular flange mounted to the lower end of the tubular air passageway means which is movable in unison with the plug-like valve. A more simple diffuser unit construction would be advantageous.

It is therefore an object of this invention to provide an air conditioning system for a grocery store or the like having refrigerated food displays or the like along certain aisles of the store and ceiling mounted air outlet diffuser units mounted in the ceiling for providing a downward flow of conditioned air into the store wherein a plurality of the air outlet diffuser units are each constructed and positioned in the store so that each diffuser unit provides a downward flow of conditioned air over an extended area of the aisle in such a manner that the shoppers moving about the aisles therebelow receive conditioned air substantially free of drafts for aiding in shopper comfort, while heavy, cool, stagnant air lying adjacent the refrigerated food displays and the like is induced upwardly into upper regions of the store above the shoppers for effecting mixing thereof in the upper regions of the store with the conditioned air flowing from the diffuser units and also for mixing with that higher temperature air inherently residing in the upper regions of the store above the shoppers.

It is still another object of the present invention to provide a ceiling mounted air diffuser unit of the aforementioned type which is adapted for use with a grocery store air conditioning system and which is constructed to provide a flow of downwardly directed air over a greater surface area therebelow in such a manner that shoppers moving about the aisles therebelow receive conditioned air substantially free of drafts for aiding in shopper comfort, while heavy, cold, stagnant air lying adjacent the refrigerated food displays and the like is induced upwardly into upper regions of the store about the shoppers for effecting mixing thereof.

SUMMARY OF THE INVENTION

These and other objects and advantages of the present invention are accomplished by an air conditioning system for a grocery store or the like having refrigerated food displays or the like along certain aisles of the store and having a ceiling which is typically of a height of about 12 feet or less. The air conditioning system includes overhead air supply conduits located above the ceiling and connected to a suitable source of conditioned air. Air outlet diffuser units are mounted in the ceiling of the store at predetermined locations and are connected to the conduits for receiving conditioned air therefrom and for providing a downward flow of conditioned air into the store. A plurality of the air outlet diffuser units are positioned substantially above the aisles adjacent the refrigerated food displays and each are constructed so as to provide a downward flow of conditioned air into the store and over an extended area of an aisle in such a manner that the shoppers moving about the aisles therebelow receive conditioned air substantially free of drafts for aiding in shopper comfort, while heavy, cool, stagnant air lying adjacent the refrigerated food displays and the like is induced upwardly into upper regions of the store above the shoppers for effecting mixing thereof in the upper regions of the store with the conditioned air flowing from the diffuser units and also for mixing with that higher temperature air inherently residing in the upper regions of the store above the occupants.

Each of the plurality of air diffuser units has a housing with a flared air exit mouth which includes an outwardly extending arcuate surface to define a rounded outlet mouth thereat. A tubular air passageway is positioned coaxially of the housing and also defines an annular air passageway between itself and the housing. A plurality of vanes are mounted in the annular air passageway for producing rotational, highly turbulent currents of air flowing from said passageway, said vanes interconnecting the tubular air passageway, and the housing. A control is associated with the tubular air passageway for controlling the volume of air passing therethrough.

The upper end of said tubular air passageway and the upper end of the annular passageway are each in fluid communication with one of the overhead conduits for receiving conditioned air therefrom. Both the flared air exit mouth of the housing and the lower end of the annular air passageway extend below the store ceiling a predetermined distance so as to position the outflow of air from the tubular air passageway and the outflow of air from the annular air passageway at a predetermined distance below the ceiling so as to avoid air flowing from the annular air passageway outwardly along the face of the ceiling and creating an undesirable coanda effect. An annular flange is connected to the lower end of the means defining the tubular air passageway. The flange extends outwardly therefrom to provide a partial constriction in the annular passageway so as to obtain a desired velocity of air discharged through the annular air passageway so that the air discharged through the annular passageway follows the arcuate surface of the flared housing and is discharged laterally therefrom to allow a greater horizontal discharge of air in the area above the aisles adjacent the refrigerated food displays. Mounting means surrounds the housing and is operably connected thereto and serves for individually mounting the plurality of air diffuser units in the ceiling of the store.

BRIEF DESCRIPTION OF THE DRAWINGS

Some of the objects and advantages of the present invention having been stated, other will be more fully understood from the detailed description which follows and by reference to the accompanying drawings in which.

DETAILED DESCRIPTION OF THE PREFERRED EMBODIMENT

Figure 1:
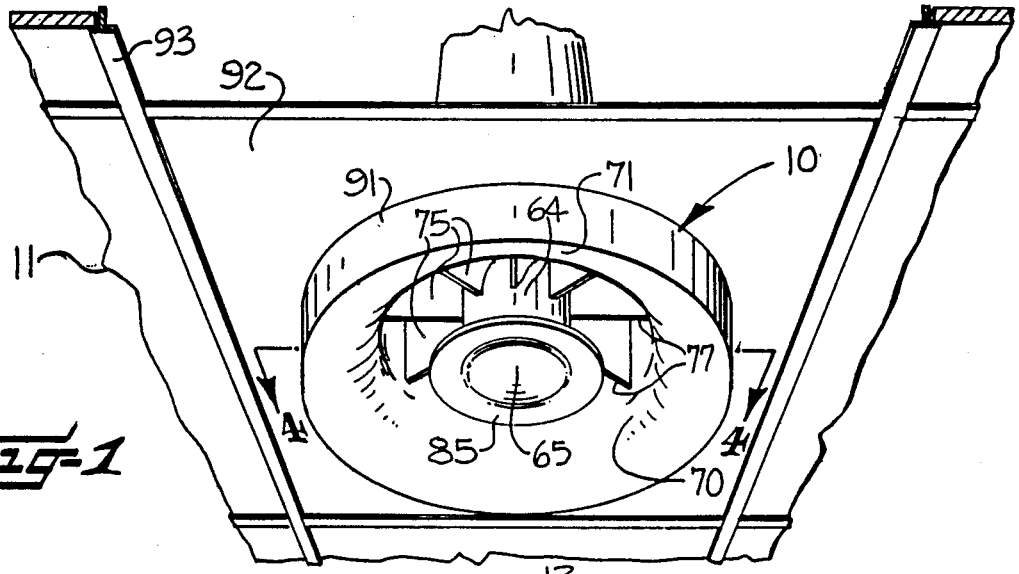
FIG. 1 is a perspective view of an air diffuser unit having a rounded outlet mouth thereat in accordance with the present invention and mounted in the ceiling of a grocery store.
Figure 2:
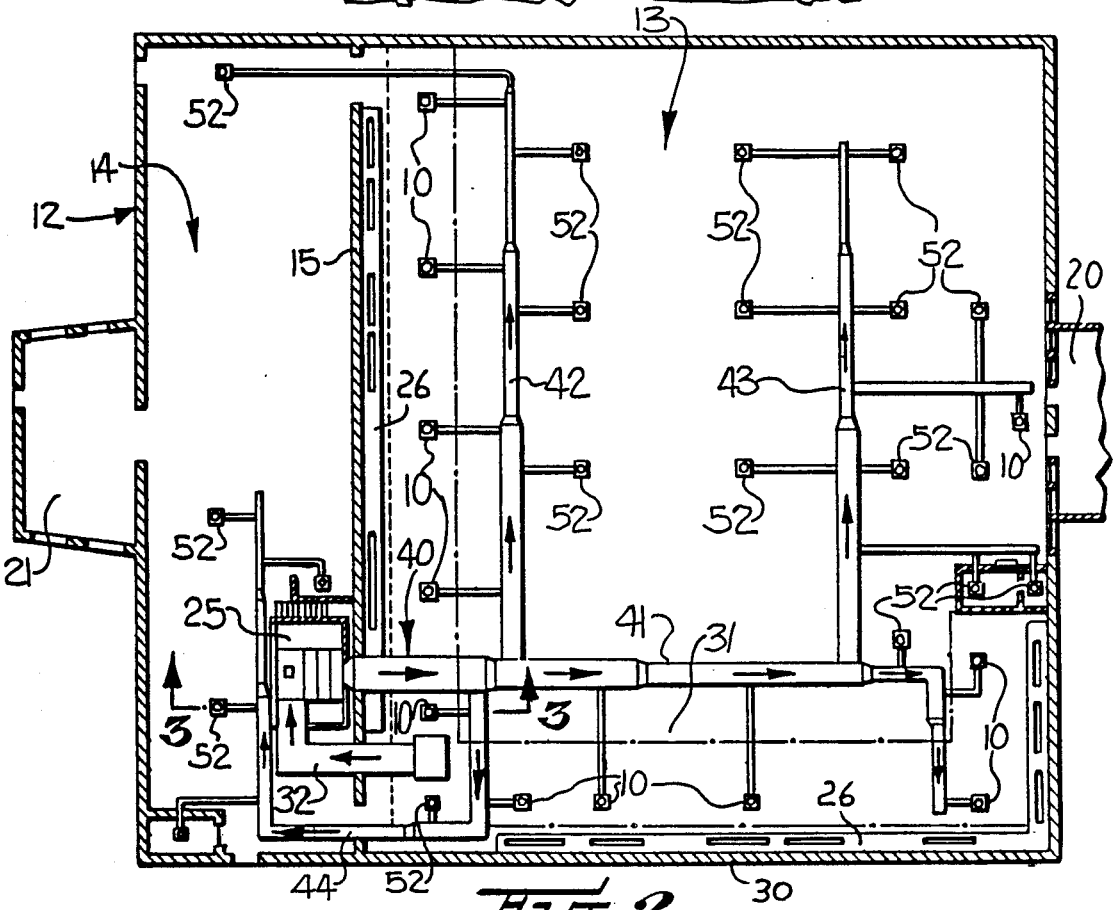
FIG. 2 is a plan view of a grocery store and showing schematically the positioning of air diffuser units in accordance with the present invention in relation to refrigerated food displays and aisles adjacent thereto.

Referring now to the drawings, and more particularly to FIG. 1, there is shown the air outlet diffuser unit 10 in accordance with the present invention mounted in the ceiling 11 of a grocery store 12 (FIG. 2). As will be explained in detail, the diffuser design is adapted for use with grocery store ceiling heights of about 12 feet or less. The present diffuser design provides a downward flow of conditioned air over an extended area of an aisle. The greater horizontal throw of air is better suited for lower ceiling heights of about 12 feet or less. Greater ceiling heights ranging above 12 feet, may require a diffuser unit design having a stepped outlet as disclosed in the parent case to provide a more downward flow of air with a lessened horizontal discharge to effect mixing of that discharged air with the colder, stagnant air lying in the aisles adjacent the refrigerated food displays. Additionally, if a stepped outlet configuration were utilized, more diffuser units would likely be needed because the horizontal throw would be lessened.

As illustrated in FIG. 2, the grocery store 12 includes a large, open shopping area 13 at the front of the store and a back storage and maintenance area 14 separated from the shopping area by a rear wall 15. The store 12 includes a front entrance 20 and a loading area 21 in the back storage room 14. Although grocery store layouts vary in design, the illustrated embodiment is typical of many grocery store layouts which include a front shopping area and back storage and maintenance area. Also, means providing a supply of conditioned air such as a conventional air conditioning and refrigeration apparatus 25 is included in the storage and maintenance area 14 to provide cooling and heating to the shopping area and the refrigerated food displays. Alternatively, the air conditioning apparatus 25 can be located on the roof. The air conditioning apparatus 25 also can include separate systems (not shown) for effecting control over various departments, i.e. dairy, meats, etc.

As illustrated, refrigerated food displays 26 are positioned along the rear wall 15 and a side wall 30 of the shopping area 13. The refrigerated food displays 26 commonly hold such items as dairy products, meats, and other refrigerated foods. As is conventionally found in most grocery store environments, aisles 31 extend adjacent the refrigerated food displays located along the walls.

Figure 3:
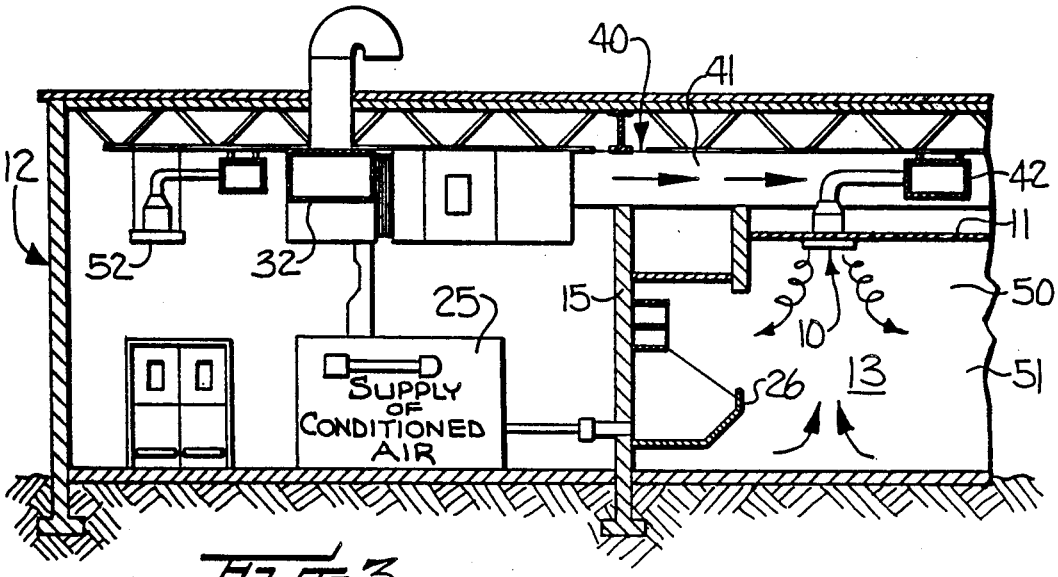
FIG. 3 is a partial sectional view of the grocery store taken along line 3—3 of FIG. 2.

As shown in FIGS. 2 and 3, the air conditioning system is characterized in that only a single air return conduit 32, or intake, is necessary for properly accommodating the entire grocery store 12 due to the enhanced mixing of the air within the store and the elimination of stagnant air areas particularly the heavy, cool, stagnant air heretofore typically present in aisles 31 adjacent refrigerated food displays 26. Heretofore, most refrigerated food displays used in a grocery store environment have included return air duct work extending beneath the refrigerated food displays. These returns drew the heavy, cool, stagnant air present in adjacent aisles beneath the food displays. Additionally, in some stores, several return air conduits were located along the side or back walls with multiple returns which drew ambient air present in the upper regions of the grocery store shopping area to an air conditioning means typically located in the back room of the store. The use of the diffuser unit 10 in accordance with the present invention obviates the need for installing return air duct work underneath refrigerated food displays and obviates the need for multiple conduits. One conduit 32 having a single or multiple pick-up point return can be used. The pick-up points can be located at any point in space in the store. Preferably, a single pick-up point as illustrated is used.

As illustrated, an overhead air supply conduit system 40 interconnects the air conditioning apparatus 25 and includes a first main conduit 41 and side conduit branches 42, 43, and 44. Air outlet diffuser units are mounted in the ceiling of the store at predetermined locations and connect to main and branch conduits 41–44 for receiving conditioned air therefrom and providing a downward flow of conditioned air into the store. A plurality of the air outlet diffuser units 10 are constructed in accordance with the present invention as illustrated in FIG. 1 and are positioned substantially above the aisles 31 adjacent the refrigerated food displays 26. A will be explained later in detail, these air outlet diffuser units 10 mounted above the aisles 31 adjacent the refrigerated food displays 26 are constructed to provide a downward flow of conditioned air into the store and over a more extended area of the aisle in such a manner that the shoppers moving about the aisles therebelow receive conditioned air substantially free of drafts for aiding in shopper comfort. The heavy, cool, stagnant air lying adjacent the refrigerated food displays 26 is induced upwardly into upper regions 50 (FIG. 3) of the store above the shoppers for effecting mixing thereof in the upper regions of the store with the conditioned air flowing from the diffuser units 10.

Figure 7:
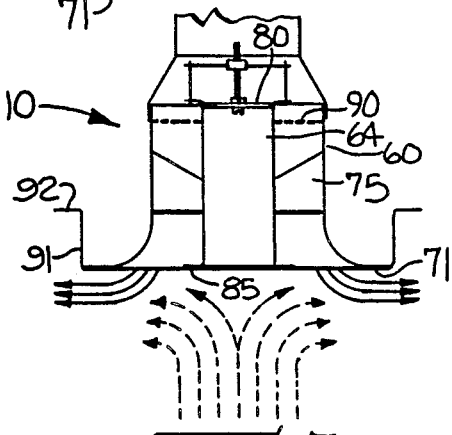
FIG. 7 is a schematic representation of the air diffuser unit in accordance with the present invention showing a substantially horizontal flow pattern of currents of air flowing from the annular air passageway when no volume of air passes through the tubular air passageway.
Figure 8:
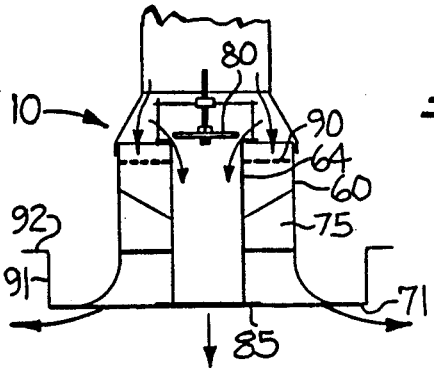
FIG. 8 is a schematic representation of the air diffuser unit in accordance with the present invention showing a horizontal flow pattern of air flowing from the annular passageway and a portion of air being directed into the tubular air passageway and directed downwardly therethrough.
Figure 9:
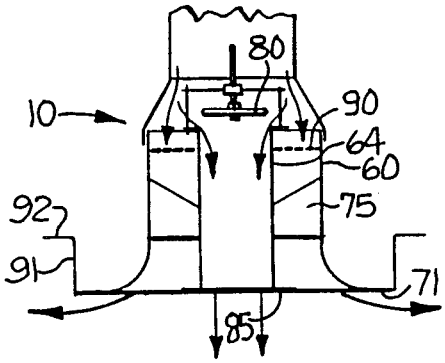
FIG. 9 is a schematic representation of the air diffuser unit in accordance with the present invention showing the flow pattern of the currents of air being directed downwardly through the tubular air passageway while also maintaining some horizontal flow of air from the annular air passageway.

This upwardly induced air also mixes with the higher temperature air inherently residing in the upper regions 50 of the store above the shoppers. Additionally, diffuser unit 10 construction in accordance with the present invention always provides for some horizontal discharge of air outwardly therefrom and over a more extended area of the aisle (FIGS. 7–9). However, the allowance for horizontal discharge limits to an extent the total volume of air directed downwardly, thus limiting the effective height at which the diffuser unit can be used.

In medial areas 51 of the grocery store 12 where typically dry good foods such as canned goods, cereals and the like are stored on gondolas and other conventional shelving units, air diffuser units 52 which are structurally different than that illustrated in FIG. 1 are used to create less of a downward flow of conditioned air into the medial area 51 of the store and allow a more horizontal flow of air outwardly from the diffuser unit. As will be explained later in detail, the diffuser units 52 positioned in medial areas 51 of the grocery store 12 provide for a discharge of air which is distributed in a pattern following the coanda effect, i.e. extending along the face of the ceiling 11 and creating an extensive bell-shaped air distribution pattern over the medial area of the grocery store. Because areas of heavy, cool, stagnant air are not as common in these medial areas 51 of a grocery store as compared to aisles 31 adjacent any refrigerated food units, less upward induction of air from aisles adjacent the dry good food gondolas is needed.

Figure 4:
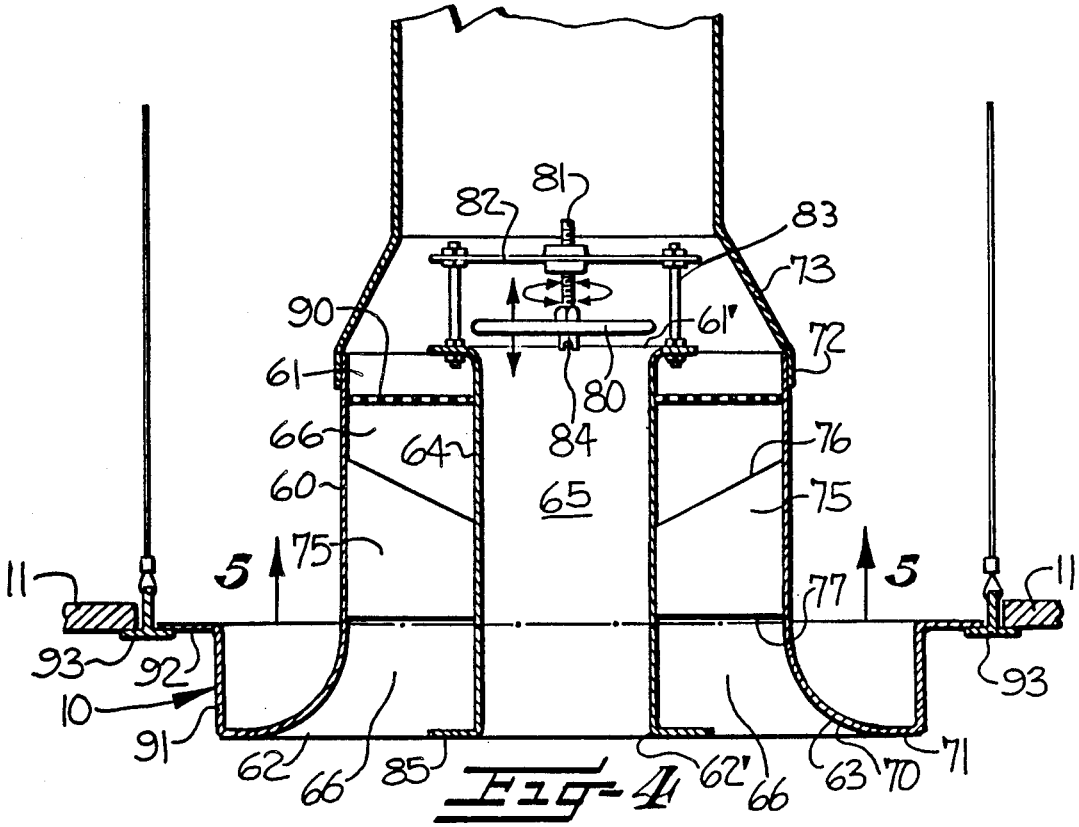
FIG. 4 is an enlarged sectional view taken along line 4—4 of FIG. 1 and showing the air diffuser unit mounted to the ceiling of a grocery store.
Figure 5:
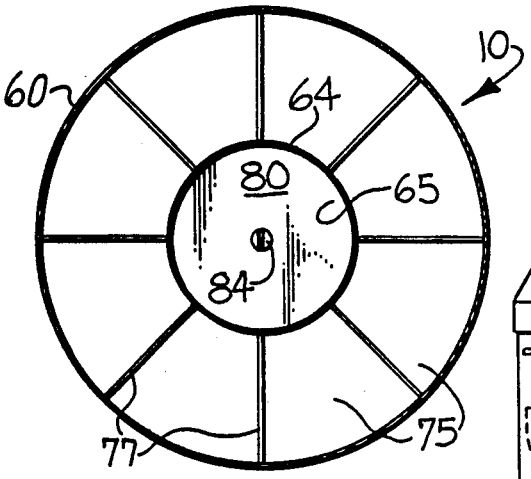
FIG. 5 is a sectional view taken along line 5—5 of FIG. 4 and showing eight vanes interconnecting the housing and the tubular air passageway.
Figure 6:
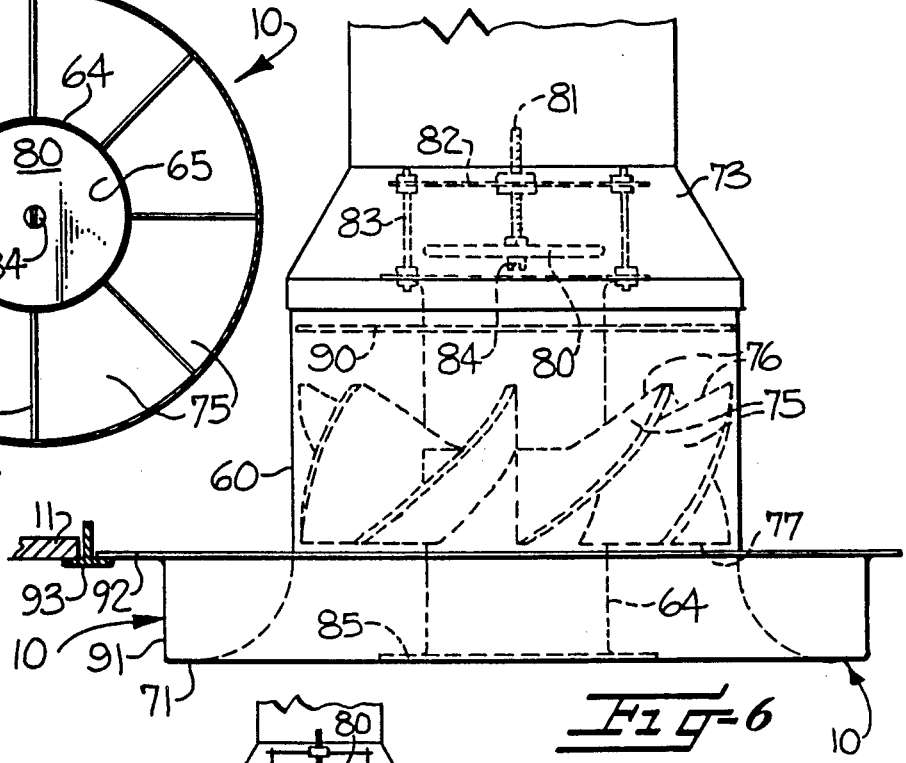
FIG. 6 is a side view of the air diffuser unit in accordance with the present invention and showing in greater detail by broken lines the configuration of the vanes.

As noted before, the air outlet diffuser unit 10 positioned above the aisles 31 adjacent the refrigerated food displays 26 is illustrated in greater detail in FIGS. 4–6. The air outlet diffuser unit 10 includes a cylindrical housing 60 having respective ingress and egress ends 61, 62 and a flared air exit mouth 63 at the egress end. Typically, the housing 60 is fabricated from light gauge sheet metal and spun using conventional metal spinning techniques. A cylindrical, tubular inner member 64 is positioned concentric to the inner surface of the housing 60 and forms a tubular air passageway 65 positioned coaxially of the housing. The tubular inner member 64 defines an annular air passageway 66 between the inner member and the housing 60.

The tubular inner member 64 also includes respective ingress and egress ends 61′, 62′ substantially flush with respective ingress and egress ends 61, 62 of the housing 60 (FIG. 4). The flared air exit mouth 63 of the housing 60 includes an outwardly extending arcuate surface 70 to define a rounded outlet mouth thereat, and as will be explained in detail later, provides for some horizontal discharge of air so that the overall pattern of air flow will be somewhat bell-shaped and extend over a more extended area of the aisle. A shortened, horizontally disposed flat annular flange portion 71 is connected to the lower end of the arcuate surface 70 of the housing 60 and defines a flat annular portion extending outwardly from the mouth 63 of the housing. The upper, outer peripheral portion 72 of the housing at the ingress end 61 is straight and can receive thereover the terminus end 73 of an air distribution conduit 41 or other air supply means and can be secured thereon by a metal band or other means conventional to the industry (FIGS. 4 and 6).

As illustrated in greater detail in FIGS. 5 and 6, a plurality of vanes 75 are mounted in the annular passageway 66 for producing a rotational, highly turbulent current of air flowing from the passageway. The vanes 75 are mounted in the lower portion of the annular passageway and interconnect the tubular inner member 64 and the housing 60 and provide support to the tubular inner member relative to the housing. Preferably eight vanes are used, a number which has been found desireable to impart sufficient rotational and high turbulence to the discharged air. The vanes 75 are positioned in the annular air passageway 66 so that the upper edge 76 of each of the vanes is positioned parallel to the lower edge 77 of an adjacent vane (FIGS. 5 and 6). Additionally, each of the vanes 75 is positioned in the annular air passageway 66 at a fixed, equal angle to each other. If air only was allowed to flow through the annular air passageway, air flowing therefrom would be discharged in a radial, horizontal air jet having a highly turbulent and rotational pattern thereto.

The diffuser also includes a vertically moveable, plug-like valve 80 positioned adjacent the upper ingress end 61' of the tubular air passageway for controlling the volume of air passing therethrough (FIG. 4). As illustrated, the plug-like valve 80 is supported by a threaded shaft 81. The shaft 81 threadably interconnects a support plate 82 which is retained by rods 83 to the tubular inner member 64. The support plate 82 maintains the shaft 81 in coaxial relation with the tubular air passageway. The shaft 81 extends below the valve 80 and at its terminus end includes a slot 84 for receiving a screw driver blade (not shown) for effecting manual adjustment of the valve.

An annular flange 85 is fixed to the lower end of the tubular inner member 64 and extends outwardly therefrom. The flange 85 provides a partial constriction in the annular passageway to obtain a desired velocity of air discharge through the annular air passageway so that the air exiting the annular passageway follows the arcuate surface 70 and exits the outlet in a substantially horizontal direction. As will be explained in detail later, the arcuate surface 70 provides for a horizontal discharge of air at all times so that when a maximum jet of vertically directed air is obtained when the plug-like valve is fully raised, the air distribution will be somewhat more bell-shaped in configuration and the flow of air will extend over a more extended area of an aisle.

A perforated air diffuser screen 90 formed from an open mesh metal screen is mounted in the housing 60 adjacent the ingress end of the annular air passageway 66 and in surrounding relation to the tubular air passageway 65. The perforated screen 90 diffuses the airflow coming from a conduit or other supply into the annular air passageway 66 for obtaining a more uniform flow of air to the vanes mounted therein. The perforated air diffuser screen 90 also serves for apportioning the amount of airflow from a conduit into the annular air passageway 66 while allowing sufficient back pressure to allow air to flow into the tubular air passageway 65 when the plug-like valve 80 is opened. The ingress end 61' of the tubular inner member 64 is rounded to provide a more streamlined flow of air therein. The air diffuser screen 90 has an open area of approximately fifty percent (50%) and preferably around forty six percent (46%). As will be explained in detail later, preferably, the housing 60 and tubular inner member 64 forming the tubular and annular air passageways 65, 66 are dimensioned so that when the plug-like valve member 80 is fully raised, up to thirty percent (30%) of the air flowing through a conduit into the diffuser unit 10 will flow through the tubular air passageway 65, while the remainder seventy percent (70%) of flowing air will flow through the annular air passageway 66 and outwardly therefrom.

As illustrated, both the flared exit mouth 63 of the housing 60 and the lower ends, i.e. the egress ends of the tubular and annular passageways 65, 66 extend below the store ceiling 11 to position the outflow of air from the tubular passageway 65 and the outflow of air from the annular passageway 66 at a predetermined distance below the ceiling so as to avoid air flowing from the annular air passageway outwardly along the face of the ceiling 11. The drop-down minimizes the vacuum which can be created between the ceiling surface and jet of discharged air by providing a space between the jet of air and ceiling which remains at close to atmospheric pressure. Depending on the size of the diffuser unit 10, which can range from a flared exit mouth width between twenty and fifty inches and a housing height between ten and eighteen inches, the flared exit mouth is dropped at least three to six inches below the ceiling level. A smaller unit of $20\times10$ inches is dropped 3 inches while a larger unit of $50\times18$ inches is dropped 6 inches.

A vertically disposed, annular band 91 surrounds the housing 60 (FIG. 4). The lower end of the band 91 is connected to the outer peripheral end of the flat flange portion 71 and has its upper peripheral end connected to a mounting plate 92 for the housing 60 whereby the air diffuser unit can be supportingly carried by the mounting plate 92. The band 91 also enhances the appearance of the diffuser unit. As illustrated, the flat flange 71 abruptly terminates at the annular band 91 so that the annular band 91 extends substantially perpendicular to the annular flange. This abrupt termination provides that the air discharged from the diffuser unit 10 will not flow outwardly over a gentle curve or radii extending upwardly toward the ceiling and thus, aid in creating the undesirable coanda effect. The mounting plate 92 typically is rectangularly configured and is dimensioned either $2\times4$ feet or $2\times2$ feet so as to rest on conventional elongate stringers 93 which support the drop ceilings formed of acoustical tiles such as commonly found in a grocery store (FIGS. 1 and 4).

The diffuser unit 10 allows a high degree of control over the grocery store air conditioning system. The conditioned air is discharged from a conduit into the diffuser unit 10. If the plug-like valve 80 over the tubular air passageway 65 is closed (FIG. 7), the air is discharged completely through the annular air passageway 66. The air discharged therefrom flows in a substantially horizontal path over the arcuate surface 70 and along the face of the ceiling 11 following the coanda effect as heretofore described. Although this horizontal airflow may be beneficial in medial areas 51 of the grocery store 12 over dry good foods stored on gondolas, this airflow is not adequate to penetrate the lower regions of the store, especially aisles 31 adjacent refrigerated food displays 26 and induce upwardly the heavy, cool, stagnant air therein. If the plug-like valve 80 is partially opened (FIG. 8), a portion of air flows into the tubular air passageway 65. Thus, a greater percentage of air is directed in a more vertical direction.

When the plug-like valve 80 is fully open (FIG. 9), up to thirty percent (30%) of the air flowing through the diffuser unit 10 is apportioned into the tubular air passage 65. This large volume of vertically directed air enters that area of the grocery store above the aisles 31 adjacent the refrigerated food displays 26. Because some of the discharged air flows along the arcuate surface 70, a portion of the air exiting the diffuser unit is discharged horizontally. The total discharge of air from the diffuser unit 10 is more bell-shaped in configuration and extends over a greater surface area of the grocery store aisle than if the air was discharged completely vertical from the diffuser unit. By adjusting the plug-like valve with means such as a screwdriver, the amount of air discharged through the tubular air passageway 65 can be varied, and the amount of vertical throw of air discharged therefrom can be adjusted so that a turbulent mixing occurs in the upper regions 50 of the store 12 below the ceiling 11 but above the area where shoppers walk the aisles 31, so that shoppers walking along the aisles will not feel drafts of air discharged from the diffuser units. The discharged air causes turbulence in the upper regions 50 of the store 12 above the aisles adjacent the refrigerated food displays 26, inducing upwardly the heavy, cool, stagnant air therein. Additionally, a diffuser unit 10 of the present invention is positioned at the entrance 20 of the store where during colder months of the year, cool, outside air creates a stagnant portion of air thereat, and the discharged air from the diffuser unit 10 induces upwardly the cool air inside the store adjacent the entrance.

As noted before, medial areas 51 of the grocery store include diffusers of alternative design which are less expensive than that of the present invention as illustrated in FIG. 1. For example, a diffuser having a coaxial hub mounted in the center of a housing and having radial, fixed vanes extending from the hub to the housing is preferred. That diffuser would allow a sufficient distribution of discharged air to flow horizontal from the diffuser along the face of the ceiling and over medial areas 51 of the store. A deep penetration of air into any aisles in these medial areas such as provided by the diffuser unit 10 as heretofore described usually is not necessary because these areas typically do not contain the heavy, cool, stagnant air such as found in aisles adjacent refrigerated food displays.

The foregoing embodiment is to be considered illustrative rather than restrictive of the invention and those modifications which come within the range of equivalence of the claims to be included therein.

That which is claimed is:

1. A grocery store or the like having refrigerated food displays or the like along certain aisles of the store and having a ceiling which is typically of a height of about 12 feet or less, the combination therewith of an air conditioning system including overhead air supply conduits located above the ceiling and connected to a suitable source of conditioned air, air outlet diffuser units mounted in said ceiling of the store at predetermined locations and connected to said conduits for receiving conditioned air therefrom and for providing a downward flow of conditioned air into the store, a plurality of said air outlet diffuser units being positioned substantially above the aisles adjacent said refrigerated food displays and each being so constructed as to provide a downward flow of conditioned air into the store in such a manner that the shoppers moving about the aisles therebelow receive conditioned air substantially free of drafts for aiding in shopper comfort, while heavy, cool, stagnant air lying adjacent said refrigerated food displays and the like is induced upwardly into upper regions of the store above the shoppers for effecting mixing thereof in the upper regions of said store with the conditioned air flowing from the diffuser units and also for mixing with that higher temperature air inherently residing in the upper regions of the store above the occupants, each of said plurality of air diffuser units having a housing with a flared air exit mouth which includes an outwardly extending arcuate surface to define a rounded outlet mouth thereat, means defining a tubular air passageway positioned coaxially of said housing and also defining an annular air passageway between itself and said housing, a plurality of vanes mounted in said annular passageway for producing rotational, highly turbulent currents of air flowing from said passageway, said vanes interconnecting said means defining said tubular air passageway and said housing, control means associated with said tubular air passageway for controlling the volume of air passing therethrough and directing the air downwardly in a more vertical direction and in a more compact flow pattern and over a smaller area of the store, the upper end of said tubular air passageway and the upper end of said annular passageway each being in fluid communication with one of said overhead conduits for receiving conditioned air therefrom, means defining a perforated air diffuser mounted in said housing adjacent the ingress end of said annular passageway and in surrounding relation to said tubular air passageway for diffusing the airflow from said conduit into said annular passageway for obtaining a more uniform flow of air to said vanes mounted therein, said perforated air diffuser also serving for apportioning the amount of airflow from said conduit into said annular passageway, both the flared exit mouth of said housing and the lower end of said annular passageway extending below said store ceiling a predetermined distance so as to position the outflow of air from said tubular passageway and the outflow of air from said annular passageway at a predetermined distance below said ceiling so as to avoid air flowing from said annular passageway outwardly along the face of said ceiling and creating an undesirable coanda effect, an annular flange connected to the lower end of said means defining said tubular air passageway and extending outwardly therefrom to provide a partial constriction in said annular passageway so as to obtain a desired velocity of air discharged through said annular air passageway so that the air discharged through said annular passageway follows the arcuate surface of said flared housing and is discharged laterally therefrom to allow a greater horizontal discharge of air in the area above the aisles adjacent the refrigerated food displays, and mounting means surrounding said housing and operably connected thereto and serving for individually mounting of said plurality of air diffuser units in the ceiling of said store.

2. A structure according to claim 1 wherein said control means includes a vertically movable plug-like valve positioned adjacent the upper ingress end of said tubular air passageway, mounting means supporting said valve, said mounting means including a support plate positioned above said ingress opening in spaced, fixed relation thereto, a shaft rotatively supported by said plate and positioned in coaxial relation with said tubular air passageway, said shaft interconnecting said plug-like valve to support said valve adjacent said tubular air passageway, and means provided on said shaft below said valve and adapted for engagement with an adjusting tool for effecting vertical adjustment of the plug-like valve by rotation of said shaft.

3. A structure according to claim 1 wherein the air diffuser units except said plurality of air diffuser units each comprises a housing, a coaxial hub, and vanes interconnecting said housing with said coaxial hub.

4. A structure according to claim 1 wherein the flared exit mouth of said housing is positioned below the store ceiling at least three inches to avoid an undesirable coanda effect.

5. A structure according to claim 1 wherein said perforated air diffuser is recessed in said housing below said ingress end of said tubular air passageway a predetermined distance and has open areas thereon of about 50%.

6. A structure according to claim 1 wherein said ceiling of said store comprises acoustical tiles and elongate stringers supportingly carry said acoustical tiles for forming a drop down ceiling in the store, and wherein said mounting means for each of said plurality of air diffusers is rectangular and is supportingly carried by said elongate stringers.

7. A structure according to claim 1 including a horizontally disposed annular flange connected to the lower end of said flared outwardly extending arcuate surface of said housing and defining a flat annular portion extending outwardly from the rounded outlet mouth of the housing.

8. A structure according to claim 7 including a vertically disposed annular band surrounding said housing and having its lower end connected to the outer peripheral end of said horizontally disposed annular flange and its upper peripheral end connected to said mounting means for said housing whereby each of said plurality of air diffuser units is supportingly carried by said mounting means.

9. A structure according to claim 1 wherein the upper edge of each of the vanes is positioned parallel to the lower edge of an adjacent vane.

10. A grocery store or the like having refrigerated food displays or the like along certain aisles of the store and having a ceiling which is typically of a height of about 12 feet or less, the combination therewith of an air conditioning system characterized in that only a single air return conduit is required for properly accommodating the entire store due to the enhanced mixing of the air within the store and the elimination of stagnant air areas, particularly heavy, cool stagnant air heretofore typically present and lying adjacent refrigerated food displays, said air conditioning system including means providing a supply of conditioned air, overhead air supply conduits located above the ceiling and connected to said supply of conditioned air for supplying conditioned air into the store, a single air return conduit for returning air from the store to said supply means for conditioned air, air outlet diffuser units mounted in said ceiling of the store at predetermined locations and connected to said air supply conduits for receiving conditioned air therefrom and for providing a downward flow of conditioned air into the store, a plurality of said air outlet diffuser units being positioned substantially above the aisles adjacent said refrigerated food displays and each being so constructed as to provide a downward flow of conditioned air into the store in such a manner that the shoppers moving about the aisles therebelow receive conditioned air substantially free of drafts for aiding in shopper comfort, while heavy, cool, stagnant air lying adjacent said refrigerated food displays and the like is induced upwardly into upper regions of the store above the shoppers for effecting mixing thereof in the upper regions of the store with the conditioned air flowing from the diffuser units and also for mixing with that higher temperature air inherently residing in the upper regions of the store above the shoppers, each of said plurality of air diffuser units having a housing with a flared air exit mouth which includes an outwardly extending arcuate surface to define a rounded outlet mouth thereat, means defining a tubular air passageway positioned coaxially of said housing and also defining an annular air passageway between itself and said housing, a plurality of vanes mounted in said annular passageway for producing rotational, highly turbulent currents of air flowing from said passageway, said vanes interconnecting said means defining said tubular air passageway and said housing, control means associated with said tubular air passageway for controlling the volume of air passing therethrough and directing the air downwardly in a more vertical direction and in a more compact flow pattern and over a smaller area of the store, the upper end of said tubular air passageway and the upper end of said annular passageway each being in fluid communication with one of said overhead supply conduits for receiving conditioned air therefrom, means defining a perforated air diffuser mounted in said housing adjacent the ingress end of said annular passageway and in surrounding relation to said tubular air passageway for diffusing the airflow from said supply conduit into said annular passageway for obtaining a more uniform flow of air to said vanes mounted therein, said perforated air diffuser also serving for apportioning the amount of airflow from said conduit into said annular passageway, both the flared exit mouth of said housing and the lower end of said annular passageway extending below said store ceiling a predetermined distance so as to position the outflow of air from said tubular passageway and the outflow of air from said annular passageway at a predetermined distance below said ceiling so as to avoid air flowing from said annular passageway outwardly along the face of said ceiling and creating an undesirable coanda effect, an annular flange connected to the lower end of said means defining said tubular air passageway and extending outwardly therefrom to provide a partial constriction in said annular passageway so as to obtain a desired velocity of air discharged through said annular air passageway so that the air discharged through said annular passageway follows the arcuate surface of said flared housing and is discharged laterally therefrom to allow a greater horizontal discharge of air in the area above the aisles adjacent the refrigerated food displays, and mounting means surrounding said housing and serving for individually mounting each of said plurality of air diffuser units in the ceiling of the store.

11. A structure according to claim 10 wherein said control means includes a vertically movable plug-like valve positioned adjacent the upper ingress end of said tubular air passageway, mounting means supporting said valve, said mounting means including a support plate positioned above said ingress opening in spaced, fixed relation thereto, a shaft rotatively supported by said plate and positioned in coaxial relation with said tubular air passageway, said shaft interconnecting said plug-like valve to support said valve adjacent said tubular air passageway, and means provided on said shaft below said valve and adapted for engagement with an adjusting tool for effecting vertical adjustment of the plug-like valve by rotation of said shaft.

12. A structure according to claim 10 wherein the air diffuser units except said plurality of air diffuser units each comprises a housing, a coaxial hub, and vanes interconnecting said housing with said coaxial hub.

13. A structure according to claim 10 wherein the flared exit mouth of said housing is positioned below the store ceiling at least 3 inches to avoid an undesirable coanda effect.

14. A structure according to claim 10 wherein said perforated air diffuser is recessed in said housing below said ingress end of said tubular air passageway a predetermined distance and has open areas thereon of about 50%.

15. A structure according to claim 10 wherein said ceiling of said store comprises acoustical tiles and elongate stringers supportingly carrying said acoustical tiles for forming a drop down ceiling in the store, and wherein said mounting means for each of said plurality of air diffuser units is rectangular and is supportingly carried by said elongate stringers.

16. A structure according to claim 10 including a horizontally disposed annular flange connected to the lower end of said flared outwardly extending arcuate surface of said housing and defining a flat annular portion extending outwardly from the rounded outlet mouth of the housing.

17. A structure according to claim 16 including a vertically disposed annular band surrounding said housing and having its lower end connected to the outer peripheral end of said horizontally disposed annular flange and its upper peripheral end connected to said mounting means for said housing whereby each of said plurality of air diffuser units is supportingly carried by said mounting means.

18. A structure according to claim 10 wherein the upper edge of each of the vanes is positioned parallel to the lower edge of an adjacent vane.

19. An air outlet diffuser unit adapted to be mounted in a ceiling of a grocery store or the like for providing a downward flow of conditioned air into the store, the air outlet diffuser unit adapted to be positioned substantially above an aisle in a grocery store adjacent a refrigerated food display, the air diffuser unit being so constructed that when mounted in the store will provide a downward flow of conditioned air into the store in such a manner that the shoppers moving about the aisle therebelow will receive conditioned air substantially free of drafts for aiding in shopper comfort, while heavy, cool, stagnant air lying adjacent the refrigerated food display would be induced upwardly into upper regions of the store above the shoppers for effecting mixing thereof in the upper regions of the store with conditioned air normally flowing from the diffuser unit and also for mixing with that higher temperature air inherently residing in upper regions of the store above the shoppers, said air outlet diffuser unit comprising a housing with a flared air exit mouth which includes a outwardly extending arcuate surface to define a rounded outlet mouth thereat, means defining a tubular air passageway positioned coaxially of said housing and also defining a annular air passageway between itself and said housing, a plurality of vanes mounted in said annular passageway for producing rotational, highly turbulent currents of air flowing from said passageway, said vanes interconnecting said means defining said tubular air passageway and said housing, control means associated with said tubular air passageway for controlling the volume of air adapted for passing therethrough and directing the air downwardly in a more compact flow pattern and over a smaller area, the upper end of said tubular air passageway and the upper end of said annular passageway each adapted to be in fluid communication with a conduit for receiving conditioned air therefrom, means defining a perforated air diffuser mounted in said housing adjacent the ingress end of said annular passageway and in surrounding relation to said tubular air passageway for diffusing the airflow from a conduit into said annular passageway for obtaining a more uniform flow of air to said vanes mounted therein, said perforated air diffuser also serving for apportioning the amount of air flow into said annular passageway, an annular flange connected to the lower end of said means defining said tubular air passageway and extending outwardly therefrom to provide a partial constriction in said annular passageway so as to obtain a desired velocity of air discharged through said annular air passageway so that the air discharged through said annular passageway follows the arcuate surface of said flared housing and is discharged laterally therefrom to allow a greater horizontal discharge of air in the area above the aisles adjacent the refrigerated food displays, and mounting means surrounding said housing and connected thereto and adapted for mounting the air diffuser unit in the ceiling of the store, said mounting means being constructed to be mounted flush with a ceiling, and wherein both the flared exit mouth of said housing and the lower end of said annular passageway extend below said mounting means a predetermined distance so as to position outflow of air from said tubular passageway and outflow of air from said annular passageway at a predetermined distance below a ceiling so as to thereby avoid air flowing from said annular passageway outwardly along the face of a ceiling and creating an undesirable coanda effect.

20. A structure according to claim 19 wherein said perforated air diffuser is recessed in said housing below said ingress end of said tubular air passageway a predetermined distance and has open areas thereon of about 50%.

21. A structure according to claim 19 including a horizontally disposed annular flange connected to the lower end of said flared, outwardly extending arcuate surface of said housing and defining a flat annular portion extending outwardly from the rounded outlet mouth of the housing.

22. A structure according to claim 19 including a vertically disposed annular band surrounding said housing and having its lower end connected to the outer peripheral end of said annular flange and its upper peripheral end connected to said mounting means for said housing whereby each of said plurality of air diffuser units is supportingly carried by said mounting means.

23. A structure according to claim 19 wherein the upper edge of each of the vanes is positioned parallel to the lower edge of an adjacent vane.

24. A structure according to claim 19 wherein said control means for controlling the volume of air passing through said tubular air passageway comprises a vertically moveable plug-like valve positioned adjacent the upper ingress end of said tubular air passageway.

* * * * *